US009836966B2

(12) United States Patent
Peterson

(10) Patent No.: US 9,836,966 B2
(45) Date of Patent: Dec. 5, 2017

(54) ACCELEROMETER INTEGRATED WITH DISPLAY DEVICE

(71) Applicant: Gentex Corporation, Zeeland, MI (US)

(72) Inventor: John C. Peterson, Grandville, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 14/807,075

(22) Filed: Jul. 23, 2015

(65) Prior Publication Data

US 2016/0027298 A1 Jan. 28, 2016

Related U.S. Application Data

(60) Provisional application No. 62/028,549, filed on Jul. 24, 2014.

(51) Int. Cl.
*G08G 1/056* (2006.01)
*G08G 1/0962* (2006.01)

(52) U.S. Cl.
CPC ..... *G08G 1/056* (2013.01); *G08G 1/0962* (2013.01)

(58) Field of Classification Search
CPC ..... G08G 1/056; G08G 1/0962; G08G 1/04; G01C 25/005; G01C 21/26; G01B 21/22; G01P 15/003; G06K 9/00805
See application file for complete search history.

(56) References Cited

U.S. PATENT DOCUMENTS 6,140,933 A * 10/2000 Bugno ..... B60R 1/12 33/333
6,456,194 B1 * 9/2002 Carlson ..... B60G 17/0165 340/440
7,004,593 B2 2/2006 Weller et al.
8,001,860 B1 * 8/2011 Preston ..... B60W 40/11 73/866.5
9,230,183 B2 * 1/2016 Bechtel ..... B60R 1/04
2003/0141762 A1 7/2003 Sartori et al.
2003/0191569 A1 10/2003 Su et al.
2003/0236622 A1 * 12/2003 Schofield ..... G01C 21/165 340/995.28
2004/0254727 A1 * 12/2004 Ockerse ..... G01C 17/28 701/535
2008/0015772 A1 * 1/2008 Sanma ..... B60K 35/00 701/408

(Continued)

FOREIGN PATENT DOCUMENTS

WO 0052661 A1 9/2000

OTHER PUBLICATIONS

International Search Report and Written Opinion of the International Searching Authority dated Dec. 3, 2015 for International Application No. PCT/US2015/041786, filed Jul. 23, 2015.

*Primary Examiner* — An T Nguyen
(74) *Attorney, Agent, or Firm* — Price Heneveld LLP; Bradley D. Johnson

(57) ABSTRACT

A driver assist system incorporated in a display device is disclosed. The system comprises an accelerometer and a controller in communication with the accelerometer. The controller is configured to receive at least one acceleration signal from the accelerometer and calculate a direction of rotation of the display device. The direction of rotation is utilized by the controller to calculate a drive side of the vehicle.

19 Claims, 5 Drawing Sheets

(56) References Cited

U.S. PATENT DOCUMENTS

| | | | | |
|---|---|---|---|---|
| 2009/0005933 | A1* | 1/2009 | Tabata | B60T 8/17557 701/42 |
| 2009/0097038 | A1* | 4/2009 | Higgins-Luthman | B60G 17/019 356/602 |
| 2009/0262074 | A1* | 10/2009 | Nasiri | A63F 13/06 345/158 |
| 2010/0253493 | A1* | 10/2010 | Szczerba | G01S 13/723 340/435 |
| 2012/0330497 | A1* | 12/2012 | De Tommasi | G01C 25/005 701/33.1 |
| 2014/0092237 | A1 | 4/2014 | Watanabe et al. | |
| 2014/0330487 | A1* | 11/2014 | Brandt | B60R 1/0612 701/49 |
| 2015/0006099 | A1* | 1/2015 | Pham | G01C 17/38 702/93 |
| 2015/0141043 | A1* | 5/2015 | Abramson | G01C 21/34 455/456.1 |
| 2015/0168174 | A1* | 6/2015 | Abramson | G01C 21/3697 701/408 |
| 2015/0312530 | A1* | 10/2015 | Karabed | B60R 1/081 348/148 |
| 2015/0325120 | A1* | 11/2015 | Cho | B60R 1/00 348/149 |
| 2016/0027298 | A1* | 1/2016 | Peterson | G08G 1/0962 340/935 |
| 2016/0224848 | A1* | 8/2016 | Oh | G06K 9/00805 |

* cited by examiner

ACCELEROMETER INTEGRATED WITH DISPLAY DEVICE

CROSS REFERENCE TO RELATED APPLICATIONS

This Application claims priority of U.S. Provisional Application No. 62/028,549, filed on Jul. 24, 2014, and the entirety of which is incorporated by reference herein.

TECHNOLOGICAL FIELD

The disclosure relates to an imager system for a vehicle.

BRIEF SUMMARY

In some embodiments, a driver assist system incorporated in a display device is disclosed. The system comprises an accelerometer and a controller in communication with the accelerometer. The controller is configured to receive at least one acceleration signal from the accelerometer and calculate a direction of rotation of the display device. The direction of rotation is utilized by the controller to calculate a drive side of the vehicle.

In another embodiment, a display device configured to detect an object approaching a vehicle is disclosed. The display device comprises an accelerometer and a controller in communication with the accelerometer. The controller is configured to receive at least one acceleration signal from the accelerometer and calculate a direction of rotation of the display device. The direction of rotation is utilized by the controller to assist in detecting at least one of a leading vehicle and an oncoming vehicle.

In yet another embodiment, a method of detecting an object on a roadway with a driver assist system of a vehicle is disclosed. The method comprises measuring an angle of rotation between a vehicle display device and a forward direction of the vehicle and identifying a drive-side of the vehicle based on the angle of rotation. The method further comprises capturing image data of a forward directed field of view relative to the vehicle. Based on the angle of rotation, the method continues to identify a characteristic of a target vehicle in the image data.

These and other features, advantages, and objects of the present disclosure will be further understood and appreciated by those skilled in the art by reference to the following specification, claims, and appended drawings.

DETAILED DESCRIPTION

Figure 1:
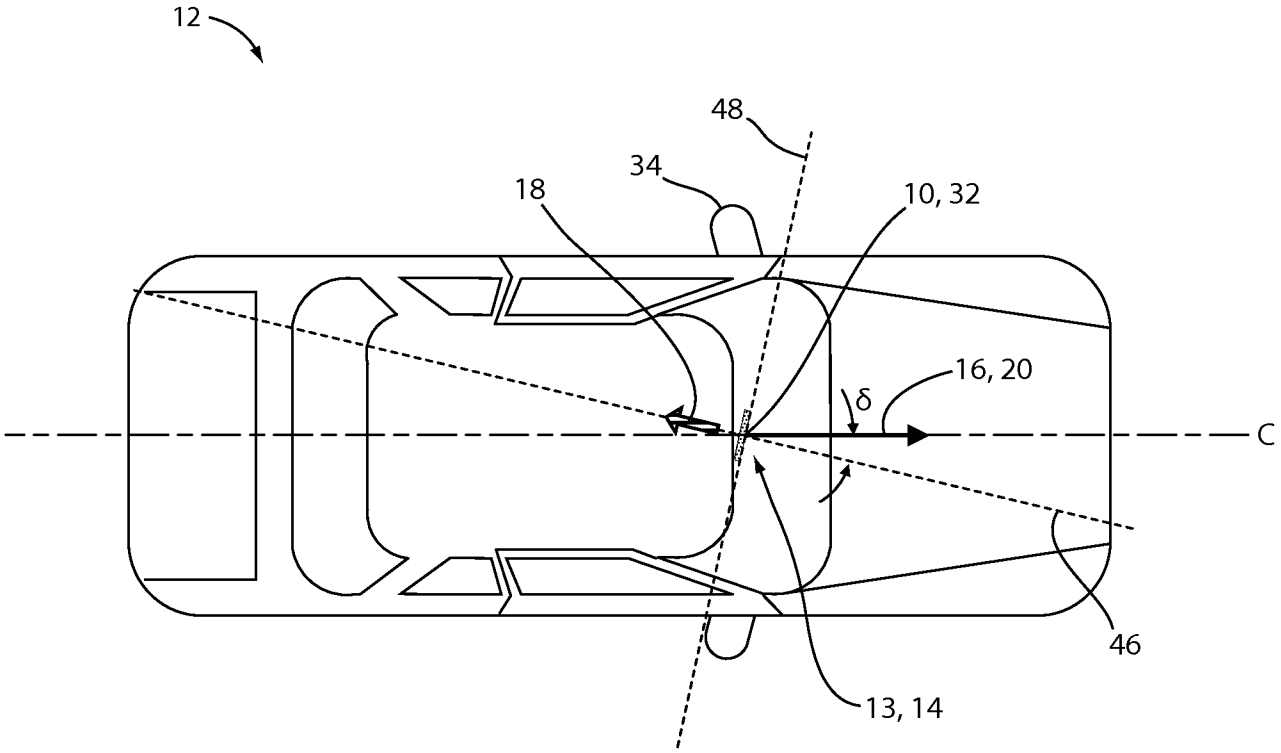
FIG. 1 is a top view of a vehicle demonstrating a display angle of a display device.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a display device 10 for a vehicle 12 is shown. The display device 10 comprises an accelerometer, a compass, and an image sensor 13 in communication with a controller 14. The accelerometer is operable to measure a forward acceleration of the vehicle 12 in the direction of a forward vector 16 and communicate corresponding acceleration data to the controller 14. The forward vector 16 refers to the forward direction of travel of the vehicle 12 as significantly projected along a centerline C of the vehicle 12. Based on the acceleration data, the controller is operable to determine a display angle δ of a display vector 18 of the display device 10 relative to the forward vector 16 of the vehicle 12.

With the display angle δ, the controller 14 is operable to offset a compass heading measured by the compass to correct for the display angle δ of the display device 10. In this way, the controller 14 is operable to correct the heading direction measured by the compass to generate an offset compass heading. The offset compass heading is adjusted based on the display angle δ to accurately display the heading of the vehicle 12 independent of the display angle δ of the display device 10. The disclosure provides for the display device 10 to utilize the accelerometer to adjust heading measured by the compass to accurately reflect a vehicle heading 20 by adjusting the compass heading by the angular offset of the display angle δ.

In some implementations, the display device 10 may comprise a rearview mirror and/or display having disposed in a housing. The compass or related circuitry may be disposed in the housing such that the compass heading may change relative to a position of the housing of the display device 10. The housing may further comprise a processor in communication with compass such that the display device 10 is operable to accurately determine the vehicle heading by adjusting the compass heading based on the display angle δ.

Figure 2:
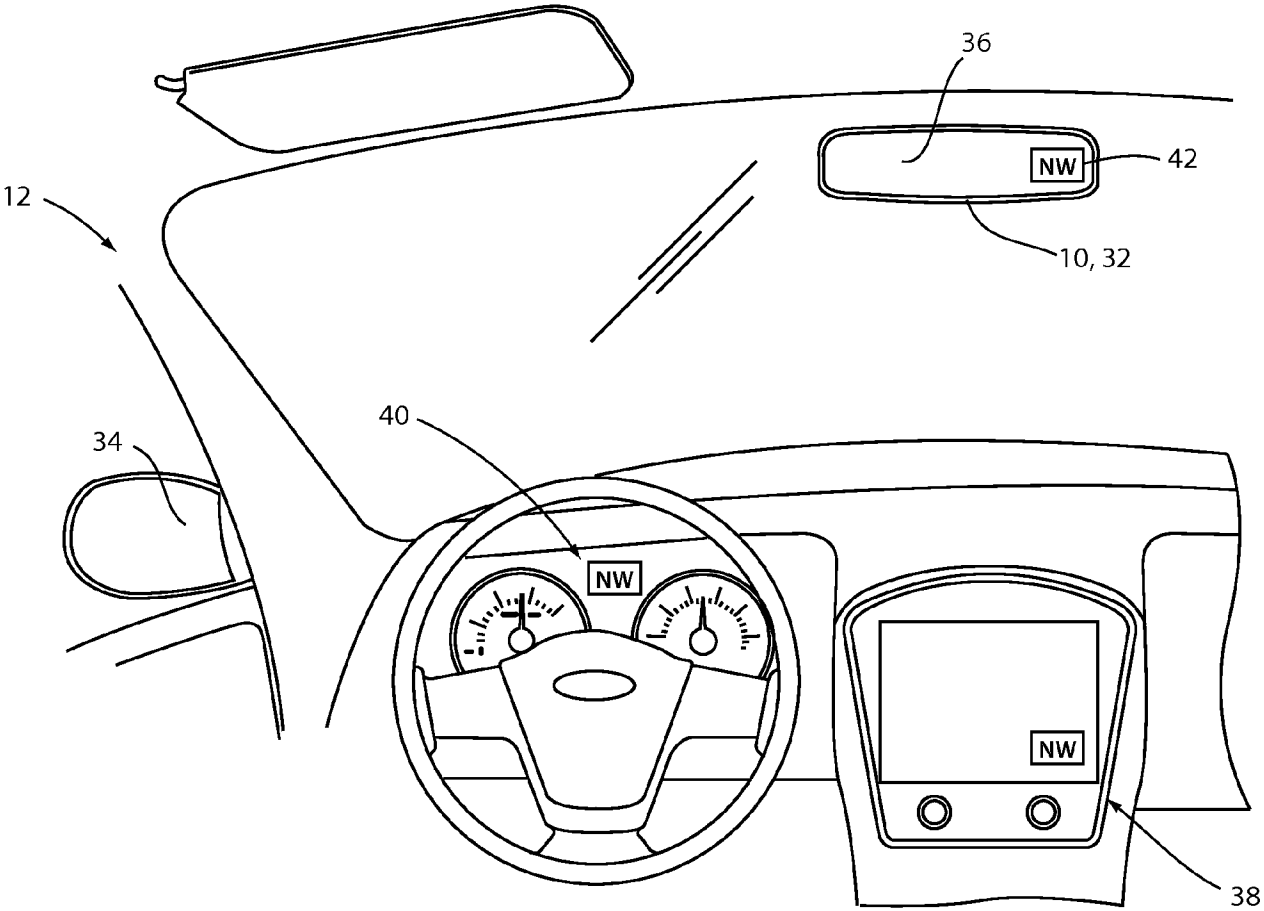
FIG. 2 is a diagram of a vehicle interior demonstrating a display device.

Referring now to FIGS. 1 and 2, the display device 10 may comprise a rearview display device and/or mirror. The rearview display device may be implemented as an interior rearview mirror 32, a side mirror 34, or any form of display configured to provide a view from the vehicle 12. In some implementations, the display device 10 may comprise a video display device operable to display a view of an exterior environment outside the vehicle via a display screen 36. The display screen 36 may comprise any form of video screen, for example a light emitting diode (LED) display, organic LED display, liquid crystal display (LCD), etc.

The display device 10 and/or at least one additional display of the vehicle 12 may be configured to receive the offset compass heading from the controller 14 and display the vehicle heading 20 as offset by the display angle δ. The controller 14 may be configured to communicate the vehicle heading 20 to the at least one additional display to assist an operator of the vehicle 12 in navigation. The controller 14 may further be in communication with one or more navigational or driver assist systems and provide the offset compass heading to such systems. The at least one additional display may include a radio and/or infotainment system 38, a gauge cluster display 40, a window 42 of the display device 10, or any other form of display operable to display alphanumeric characters corresponding to a compass heading.

In some implementations, the controller 14 is operable to calculate the display angle δ and the offset compass heading when the vehicle 12 is accelerating significantly parallel to the forward vector 16. The controller may utilize the compass to determine if the vehicle 12 is accelerating consistently along the forward vector 16 or if the vehicle 12 is turning and accelerating along a curve (e.g. turning the vehicle 12). In order to determine if the vehicle 12 is accelerating consistently along the forward vector 16, the controller 14 may compare a plurality of measurements from the compass over a temporal period to ensure that a compass heading of the vehicle is within a predetermined range. The predetermined range may correspond to a change in the compass heading being less than at least one predetermined value.

If the change in compass heading is sufficiently small or within the predetermined range, the controller 14 is operable to utilize the acceleration data for the same temporal period to update and/or calculate the display angle δ and the corresponding offset compass heading. If the compass heading during the temporal period varies sufficiently to exceed or fall below a maximum or minimum of the predetermined range, the display angle δ may not be calculated to ensure that the offset compass heading is accurate. Under such circumstances, a previously stored display angle δ may be utilized to provide the offset compass heading.

The offset compass heading may be calculated based on a trigonometric relationship between the forward vector 16 and the display vector 18. The accelerometer may comprise a plurality of axial measurement directions, for example an x-axis and a y-axis. Each of the axial measurement directions may be aligned with the compass and the display device 10 such that a y-axis 46 is aligned with the display vector 18 and an x-axis 48 is aligned perpendicular to the display vector 18. Upon a significantly forward acceleration along the forward vector 16 (within the predetermined range) as discussed above, the controller 14 is configured to receive acceleration data from the accelerometer and calculate the display angle δ.

A significant acceleration may vary based on the sensitivity of a particular accelerometer. In general, the significant acceleration may correspond to the forward acceleration exceeding a predetermined acceleration threshold. The predetermined acceleration threshold may vary based on a noise level detected by a particular accelerometer, and in some implementations, may correspond to a forward acceleration of at least $^{+}/_{-}0.1$ g.

Figure 3:
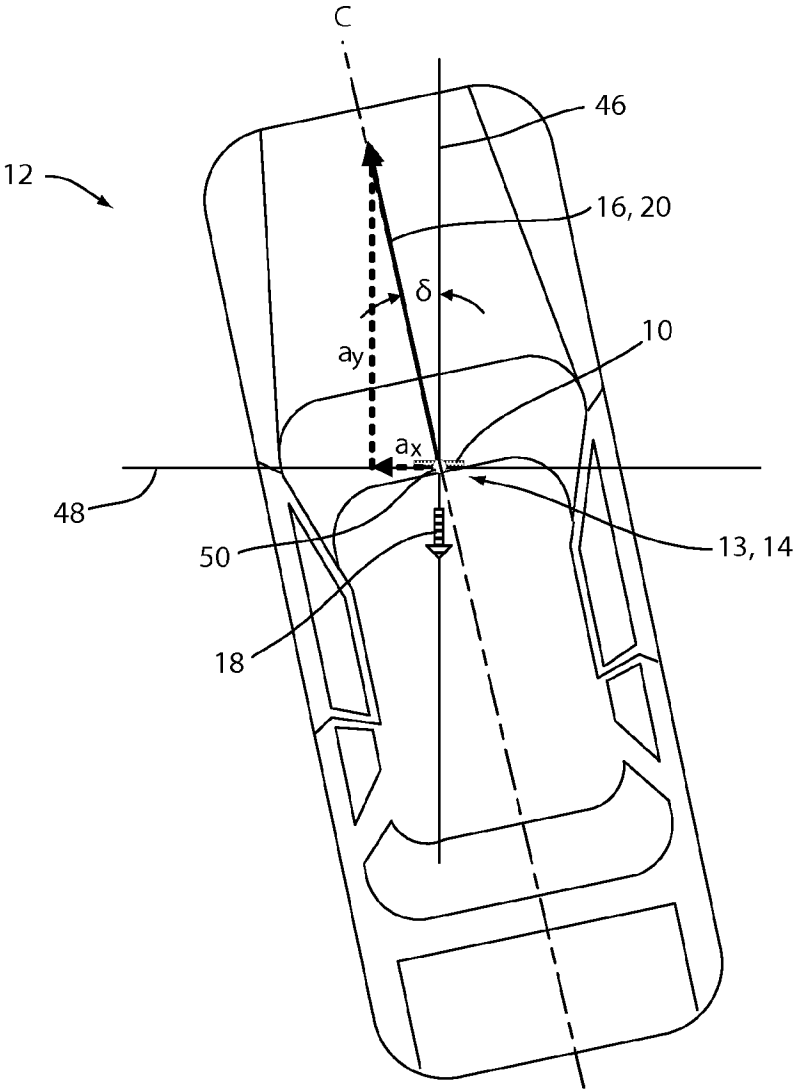
FIG. 3 is a top view of a vehicle demonstrating a display angle of a display device.

Referring now to FIG. 3, the display angle δ of the display device 10 may result in the acceleration data along the forward vector 16 having an acceleration component along the display vector 18 corresponding to the y-axis 46 and an acceleration component perpendicular to the display vector 18 along the x-axis. The relationship of the display angle δ, to the x-axis 48 and the y-axis 46 is denoted as $\delta = \arctan\left(\frac{a_x}{a_y}\right)$, wherein the acceleration in the x direction is $a_x$ and the acceleration in the y direction is $a_y$. Based on this relationship, the display angle δ is calculated and the compass direction of the display device 10 is updated to align with the forward vector 16 of the vehicle 12 as the offset compass heading. The accelerometer may further comprise another axial measurement direction corresponding to a z-axis 50 configured to calibrate the y-axis 46 and the x-axis 48 to gravity to further improve the accuracy of the offset compass heading.

Figure 4A:
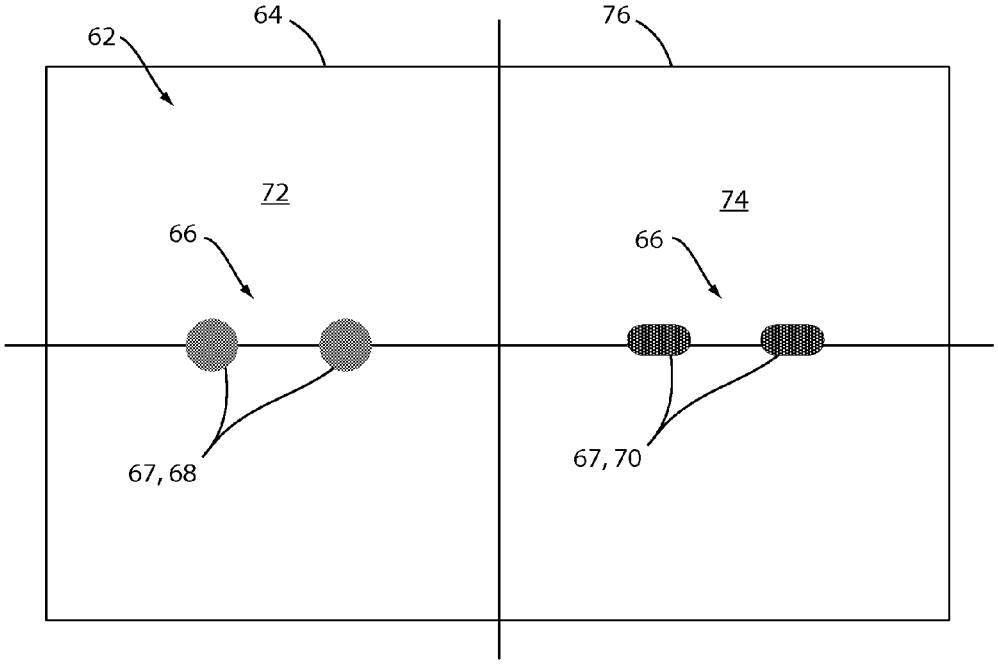
FIG. 4A is a diagram of a field of view of an image sensor corresponding to a right drive configuration.
Figure 4B:
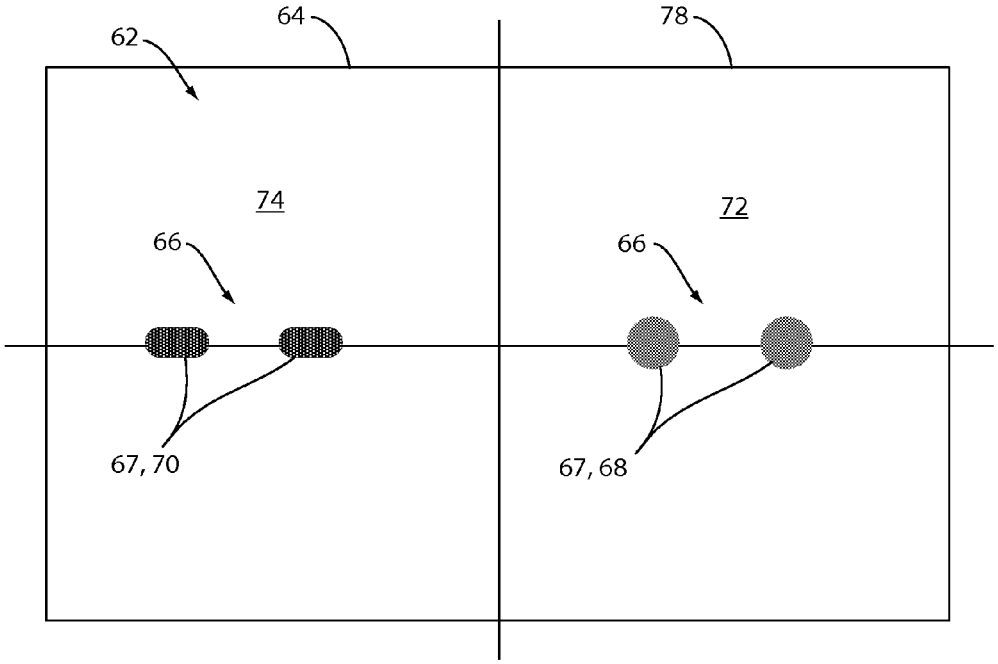
FIG. 4B is a diagram of a field of view of an image sensor corresponding to a left drive configuration.

Referring now to FIGS. 4A and 4B, image data is demonstrated in a field of view 64 of the image sensor 13. The image sensor 13 may correspond to any form of image or light sensor configured to capture image data 62 corresponding to the field of view 64 of the image sensor 13. The image sensor 13 may correspond to the imager disclosed in the SMART BEAM lighting control system manufactured by Gentex Corporation described in commonly assigned U.S. Provisional Patent Application Nos. 60/900,588, 60/902,728 and 61/008,762; U.S. Patent Nos. 8,289,430, 8,305,471, 8,587,706, and 8,629,927, the disclosures of each of the above are incorporated in their entireties herein by reference.

In some implementations, the controller 14 is in communication with the image sensor 13 and is configured to identify at least one characteristic to detect a target vehicle 66. The at least one characteristic may refer to a light source 67, for example one or more headlamps, taillights, running lights, etc. The controller 14 is operable to detect the target vehicle 66 by identifying the at least one characteristic, and further by identifying the movement and/or behavior of the at least one characteristic over time. The motion of the at least one characteristic may be determined based on the relative location of the characteristic in a sequence of image data corresponding to a temporal period. The at least one characteristic identified by the controller 14 to detect the target vehicle 66 may comprise headlights, taillights, running lights, or any other identifying characteristic corresponding to the target vehicle 66.

For example, the controller 14 is operable to identify a plurality of headlamps 68 or tail lamps 70 of the target vehicle 66 based on the relative positions of each of the headlamps 68 or tail lamps 70 in a sequence of image data. Based on the relative location of the headlamps 68 or tail lamps 70 in the field of view 64, the controller may identify an oncoming vehicle or a vehicle traveling in a common direction. Based on the display angle δ of the display device 10, the controller may be operable to determine a driver side of the vehicle 12 to assist in determining an oncoming portion 72 and a common portion 74 of traffic.

Referring to FIG. 4A, an illustration of a right drive field of view 76 demonstrates the headlamps 68 of oncoming traffic located in a left portion and the tail lamps 70 of the traffic travelling in the common direction in a right portion. Referring to FIG. 4B, an illustration of a left drive field of view 78 demonstrates the headlamps 68 of oncoming traffic located in a right portion and the tail lamps 70 of the traffic travelling in the common direction in a left portion. If the controller 14 determines that the display angle δ is directed toward a left portion of the interior of vehicle 12 relative to the forward vector 16, the controller is configured to detect vehicles corresponding to the right drive field of view 76 configuration. If the controller 14 determines that the display angle δ is directed toward a right portion of the interior of the vehicle 12 relative to the forward vector 16, the controller 14 is configured to detect vehicles corresponding to the left drive field of view 78 configuration. In this way, the controller can improve a detection of the target vehicle 66 based on a drive side which may further correspond to a geographic area of operation of the vehicle 12.

Figure 5:
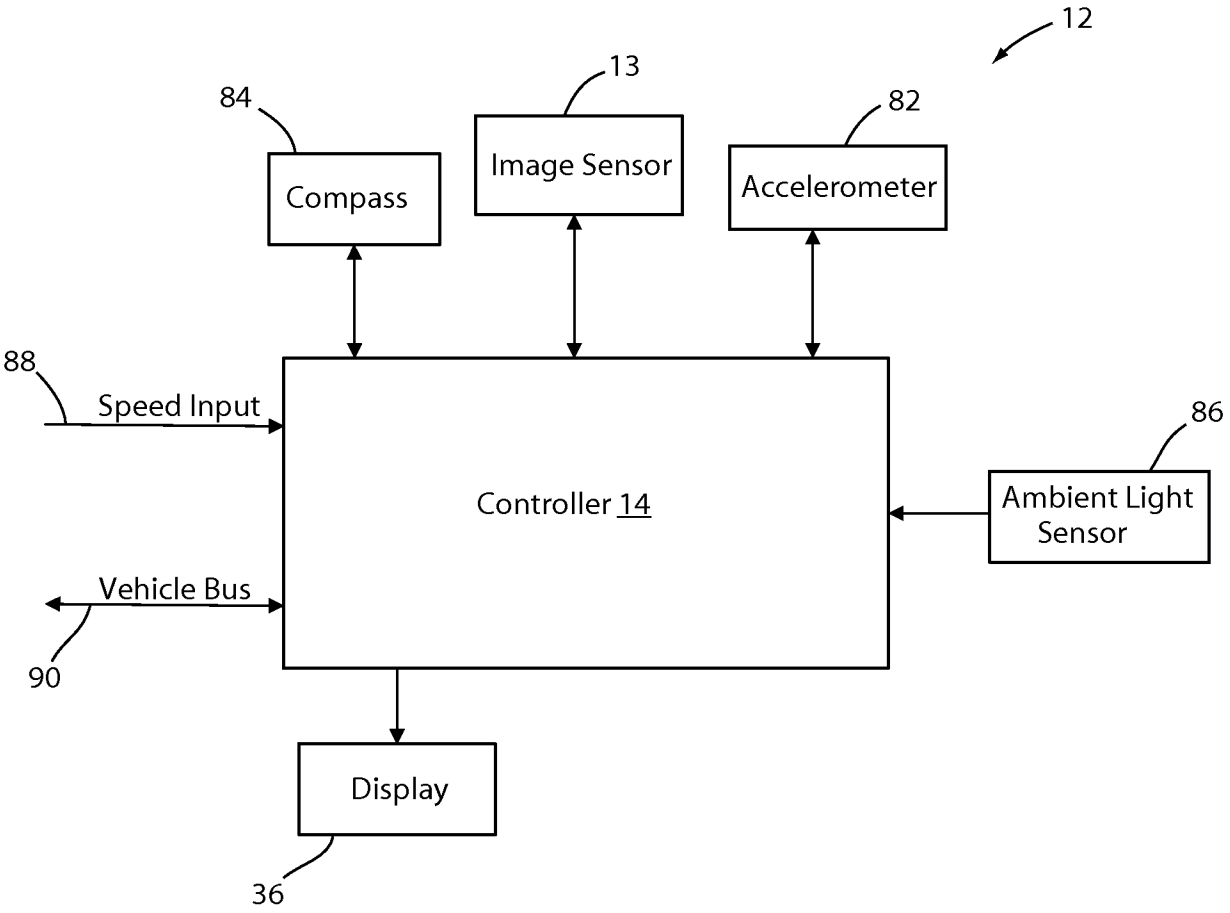
FIG. 5 is a block diagram of a controller configured to adjust a compass heading in accordance with the disclosure.

Referring to FIG. 5, a block diagram of the controller 14 is shown. The image sensor 13 is in electrical communication with the controller 14 which comprises a processor. The processor is configured to receive image data from the image sensor 13. The processor is further configured to process images corresponding to the image data to detect the at least one characteristic corresponding to the target vehicle 66. The processor may be in communication with a memory configured to store the image data during processing. The processor may be implemented using a microcontroller, a microprocessor, a digital signal processor, a programmable logic unit, a discrete circuitry, or any combination thereof. Additionally, the microcontroller may be implemented using more than one microprocessor.

The controller 14 is shown in communication with the accelerometer 82, the image sensor 13, and the compass 84. The accelerometer 82 may comprise a 3-axis accelerometer and may be configured to measure a range of approximately +/− 4 g at a resolution of approximately 16-bits. The accelerometer 82 may further be operable to operate in a wide range of temperatures and have an effective sampling rate of approximately 25 Hz. The accelerometer signal as discussed herein may include a plurality of accelerometer signals which may correspond to each axis of the accelerometer 82. Though specific performance characteristics corresponding to the accelerometer 82 are discussed herein, a variety of accelerometers may be utilized according to the particular precision, operating parameters of the controller 14, and the operating conditions/environments of a particular host vehicle.

The image sensor 13 may correspond to any form of image or light sensor, for example a charge-coupled devices (CCD) or complementary metal-oxide-semiconductor (CMOS). Further, detailed descriptions image sensors and vehicle detection systems configured to detect a target vehicle are described in commonly assigned U.S. Pat. Nos. 5,837,994; 5,990,469; 6,008,486; 6,130,448; 6,130,421; 6,049,171; 6,465,963; 6,403,942; 6,587,573; 6,611,610; 6,621,616; 6,631,316; 6,774,988; 6,861,809; and 8,045,760; and U.S. Provisional Patent Application Nos. 60/404,879 and 60/394,583, the disclosures of which are also incorporated herein in their entireties by reference. Also, commonly assigned U.S. Provisional Application Nos. 60/780,655 and 60/804,351; U.S. Patent No. 8,339,526;and U.S. patent application Publication No. 2009/0096937 describe various displays for use with the present disclosure. The entire disclosures of each of these applications are also incorporated herein by reference.

The compass 84 may be implemented as any device operable to determine an absolute or relative direction or compass heading of the vehicle 12, for example a magnetometer, etc. Further detailed descriptions of display devices configured to display a compass heading are described in commonly assigned U.S. Pat. Nos. 6,140,933; 6,968,273; 7,149,627; and 6,023,229. An ambient light sensor 86 is further in communication with the controller 14. The ambient light sensor 86 may be utilized in combination with the image sensor 13 to provide additional data to identify the at least one characteristic corresponding to the target vehicle 66. For example, the controller may utilize an ambient light signal from the ambient light sensor 86 to identify the lighting conditions of the operating environment to determine a lighting level contrast to detect the target vehicle 66.

In order to assist in the detection of the target vehicle 66, the controller 14 may further utilize various input signals corresponding to the operating conditions of the vehicle 12. A speed input 88 may be utilized to provide vehicle speed information to the controller 14. The speed input 88 may be utilized by the controller 14 in addition to the image data received from the image sensor 13 to identify and discern among non-target objects and approaching vehicles. The controller 14 may further be in communication with a vehicle bus 90 configured to send and receive operating information pertaining to the vehicle 12. In some implementations, the vehicle bus may be utilized to communicate the adjusted compass heading to additional vehicle systems, some of which are discussed herein.

The disclosure provides for various benefits including reducing manufacturing time, complexity, and cost by limiting communications to the display device 10 from a vehicle communication bus. Further benefits include a reduced likelihood of a manufacturing error that may occur if a mirror configured for a right drive vehicle was installed in a left drive vehicle. By providing for the display device 10 to measure the display angle δ and update the compass heading based on an orientation of the display device 10 relative to a vehicle heading, the disclosure provides for improved accuracy and reliability in the compass heading measured by the display device 10.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

The invention claimed is:

1. A driver assist system incorporated in a display device comprising:

an accelerometer;

a controller in communication with the accelerometer, the controller configured to:

receive at least one acceleration signal from the accelerometer; and calculate a direction of rotation of the display device relative to an operating direction of a vehicle based on the at least one acceleration signal, wherein the direction of rotation is utilized by the controller to calculate a drive side of the vehicle, wherein the drive side of the vehicle comprises a left-hand traffic direction and a right-hand traffic direction.

2. The system according to claim 1, wherein the direction of rotation is defined about a normal axis relative to a surface on which the vehicle is resting.

3. The system according to claim 1, further comprising an image sensor configured to communicate image data corresponding to a field of view to the controller.

4. The system according to claim 3, wherein the field of view corresponds to a forward directed field of view.

5. The system according to claim 3, wherein the controller is configured to identify a target vehicle based on the image data and the drive side of the vehicle.

6. The system according to claim 5, wherein the controller is configured to identify a portion of a field of view to search for headlights and a portion of the field of view to search for taillights in response to the drive side of the vehicle.

7. A display device configured to detect an object approaching a vehicle, the device comprising:

an accelerometer;

a controller in communication with the accelerometer, the controller configured to:

receive at least one acceleration signal from the accelerometer;

calculate a direction of rotation of the display device as a display angle relative to a forward operating vector of the vehicle, wherein the direction of rotation is utilized by the controller to assist in detecting at least one of a leading vehicle and an oncoming vehicle.

8. The device according to claim 7, wherein the direction of rotation corresponds to an angle between the display device and a forward direction of the vehicle.

9. The device according to claim 7, further comprising an image sensor configured to communicate image data corresponding to a field of view to the controller.

10. The device according to claim 9, wherein the controller is further operable to detect the at least one of the leading vehicle and the oncoming vehicle in the image data based at least in part on the direction of rotation.

11. The system according to claim 7, wherein the controller is configured to utilize the direction of rotation to identify whether an object detected is in oncoming traffic or common traffic.

12. The device according to claim 7, further comprising a compass configured to communicate a direction signal to the controller.

13. The device according to claim 12, wherein the controller is configured to utilize the direction signal to identify a turning condition of the vehicle.

14. The device according to claim 13, wherein the turning condition is identified by the controller by comparing measurements of the direction signal to determine if the vehicle is moving along a substantially forward vector.

15. A method of detecting an object on a roadway with a driver assist system of a vehicle, the method comprising:

measuring acceleration data in a vehicle display device;

measuring an angle of rotation between the vehicle display device and a forward direction of the vehicle based on the acceleration data;

identifying a drive-side of the vehicle based on the angle of rotation;

capturing image data of a forward directed field of view relative to the vehicle; and identifying a characteristic of a target vehicle in the image data based on the angle of rotation.

16. The method according to claim 15, wherein the characteristic of the target vehicle corresponds to at least one of a headlamp, tail lamp, and a running light.

17. The method according to claim 15, wherein the identifying the characteristic consists of searching a first portion of the field of view for a headlamp and a second portion of the field of view for a tail lamp.

18. The method according to claim 15, wherein the drive side is utilized to identify if the first portion corresponds to a left portion or a right portion of the field of view.

19. The method according to claim 15, wherein the angle of rotation corresponds to a direction of a display of the display device relative a forward direction of the vehicle.

* * * * *